United States Patent [19]

Harada

[11] Patent Number: 4,696,266

[45] Date of Patent: Sep. 29, 1987

[54] DECOMPRESSION APPARATUS FOR ENGINES

[75] Inventor: Mitsuyoshi Harada, Gyoda, Japan

[73] Assignee: Fuji Jukogyo Kabushiki Kaisha, Tokyo, Japan

[21] Appl. No.: 879,645

[22] Filed: Jun. 27, 1986

[30] Foreign Application Priority Data

Jul. 5, 1985 [JP] Japan ..... 60-102524

[51] Int. Cl.[4] ..... F01L 13/08

[52] U.S. Cl. ..... 123/182; 123/90.16

[58] Field of Search ..... 123/316, 90.16, 182

[56] References Cited

U.S. PATENT DOCUMENTS

| | | | |
|---|---|---|---|
| 3,362,390 | 1/1968 | Esty | 123/182 |
| 3,381,676 | 5/1968 | Campen | 123/182 |
| 3,496,922 | 2/1970 | Campen | 123/182 |
| 3,511,219 | 5/1970 | Esty | 123/182 |
| 3,620,203 | 11/1971 | Harkness | 123/182 |
| 3,901,199 | 8/1975 | Smith | 123/182 |
| 3,981,289 | 9/1976 | Harkness | 123/182 |
| 4,440,126 | 4/1984 | Abermeth et al. | 123/90.18 |
| 4,610,227 | 9/1986 | Nakano et al. | 123/182 |
| 4,615,312 | 10/1986 | Tsumiyama | 123/182 |

FOREIGN PATENT DOCUMENTS

| | | | |
|---|---|---|---|
| 0167691 | 1/1986 | European Pat. Off. | 123/182 |
| 50-7381 | 3/1975 | Japan . | |
| 1445780 | 8/1976 | United Kingdom | 123/182 |

*Primary Examiner*—Craig R. Feinberg
*Assistant Examiner*—David A. Okonsky
*Attorney, Agent, or Firm*—Martin A. Farber

[57] ABSTRACT

A decompression apparatus for an engine has a valve releasing lever comprising a shaft and a weight secured to the shaft. The shaft forms a semicircular cam at its one end. Recesses are provided on a camshaft and a bore of a cam gear, and a key is engaged in both recesses to secure the camshaft and the cam gear. The semicircular cam is rotatively supported on a flat bottom notch provided on the camshaft close to an actuating cam, and the shaft is rotatively inserted in a hole provided in the key.

4 Claims, 5 Drawing Figures

DECOMPRESSION APPARATUS FOR ENGINES

BACKGROUND OF THE INVENTION

The present invention relates to a decompression apparatus for an internal combustion engine designed to make starting of the engine easier in such a manner that at least either an intake valve or an exhaust valve is forcedly opened at engine starting and the valve open condition is automatically terminated after the engine starts.

Such a decompression device has been known which is automatically operated to open either an intake valve or an exhaust valve to a small extent to reduce the compression pressure in combustion chambers during starting and thereby to reduce the starting load of the engine.

Japanese Utility Model Publication No. 50-7381 discloses an automatic decompression device which is operated by the centrifugal force of a weight and automatically reduces pressure in a combustion chamber during the starting of an engine. In the known device, the decompression device needs not only many parts because of complexity in construction but also much time to make and assemble it.

Particularly in an engine whose output shaft, power-take-off (PTO) shaft, is one end of a camshaft, it is difficult to provide a releasing lever on the camshaft between the output shaft portion and a cam of the camshaft since the diameter of the output shaft must be rather large.

SUMMARY OF THE INVENTION

The object of the present invention is to provide a decompression apparatus which may reduce the number of parts and save assembly time, and also can be available for different models of the engine.

According to the present invention, there is provided a decompression apparatus for an engine having a camshaft, a cam gear having a bore in the center thereof, and a tappet engaging with a cam on the camshaft, and a releasing lever comprising a shaft and a weight secured to the shaft. The shaft forms a semicircular cam at one end. The camshaft has a first recess in the longitudinal direction, and the bore has a second recess. A bearing member engages with the first and second recesses and rotatably supports the shaft. A flat bottom notch supports the semicircular cam and is provided on the camshaft close to the cam. The semicircular cam is arranged to protrude from the periphery of the cam when the engine operation is stopped.

The other objects and features of this invention will become understood from the following description with reference to the accompanying drawings.

DETAILED DESCRIPTION OF THE PREFERRED EMBODIMENT

Figure 1:
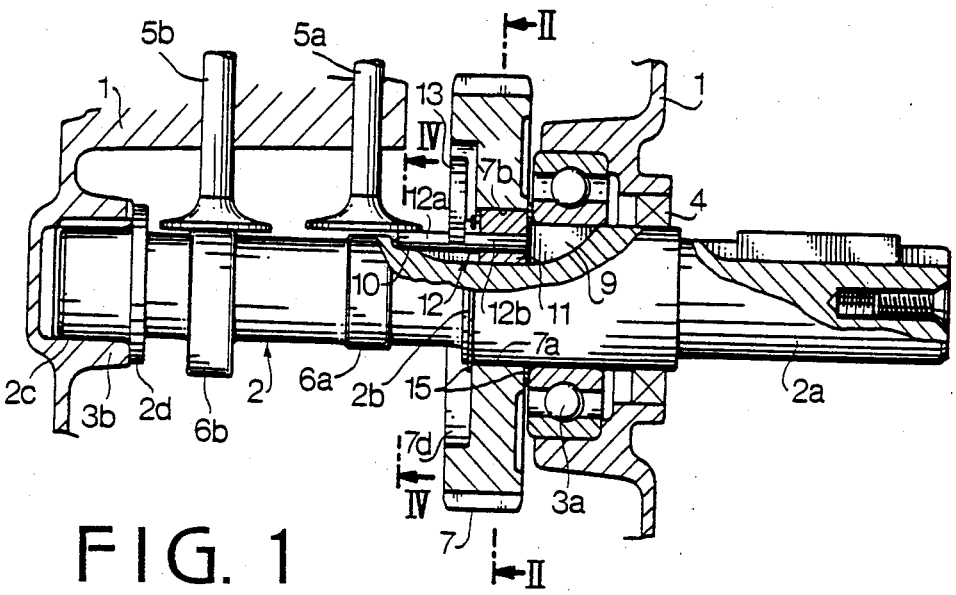
FIG. 1 is a sectional view of a decompression apparatus according to the present invention.
Figure 2:
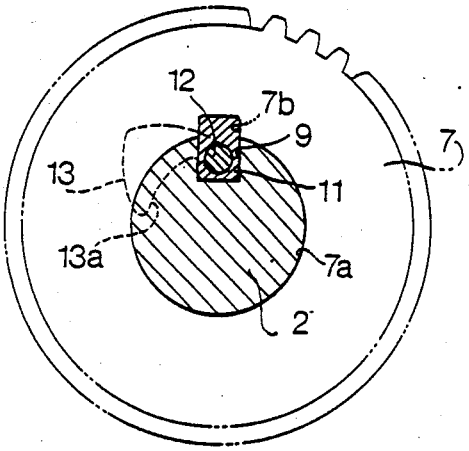
FIG. 2 is a sectional view taken along a line II—II of FIG. 1.

Referring to FIG. 1, a crankcase 1 of an engine has bearings 3*a* and 3*b* which support a camshaft 2.

One end of the camshaft 2 is utilized as an output shaft, or a power-take-off (PTO) shaft 2*a*. The output shaft 2*a* protrudes outside of the crankcase 1 via sealing member 4. An actuating cam 6*a* for an intake valve (not shown) and an actuating cam 6*b* for an exhaust valve (not shown) are integrally formed on the camshaft 2 in a position corresponding to a tappet 5*a* for the intake valve and a tappet 5*b* for the exhaust valve, respectively. Another one 2*c* of the camshaft 2 is supported by the bearing 3*b* and positioned by a flange 2*d*.

A recess 9 like a key way is formed on the camshaft 2 by cutting away a portion of the periphery of the camshaft 2 between a portion corresponding to the bearing 3*a* and the cam 6*a* along its axial direction. The recess 9 is positioned so as to face the tappet 5*a* at the compression stroke of a piston (not shown). A flat bottom notch 10 is provided on the camshaft 2 between the recess 9 and a side wall of the cam 6*a*.

A cam gear 7 which is engaged with a gear of a crankshaft (not shown) has a longitudinal bore 7*a* along the central axis thereof and on which a recess 7*b* is provided with the same width as the recess 9 on the camshaft 2.

A hollow 7*d* is formed on one side of the cam gear 7 facing the tappet 5*a* to be provided with a weight 13 of a releasing lever 12 which will be described hereinafter. In the hollow 7*d*, a stopper pin 7*c* (see FIG. 5) is mounted to project from the hollow surface and to arrest the releasing lever 12 so that the rotary movement of the releasing lever 12 is restricted when the centrifugal force is increased. Snap rings 15 are engaged on the camshaft 2 to prevent axial movement of the cam gear 7.

Further fitted into both recesses 9 and 7*b* is a bearing member or key 11 through which an end portion 12*b* of the releasing lever 12 is rotatably supported.

Figure 3:
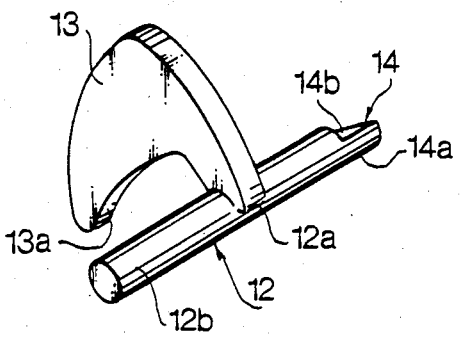
FIG. 3 is a perspective view of a releasing lever.

As shown in FIG. 3, the releasing lever 12 has the weight 13 in one united body on its shaft 12*a* approximately at the center in the axial direction. A semicircular cam 14 is provided at one end of the shaft 12*a*. The semicircular cam 14 is cut away in the axial direction forming a flat reduced portion 14*b* which comes into a position facing the underside of the tappet 5*a* when assembled. A cylindrical portion 14*a* of the semicircular cam 14 has the same diameter as the shaft 12*a* and the end portion 12*b* of the releasing lever 12.

The semicircular cam 14 is rotatably supported on the flat bottom notch 10 of the camshaft 2. The end of the semicircular cam 14 is closely located at a side of the cam 6*a* to prevent the axial movement of the lever 12.

Figure 4:
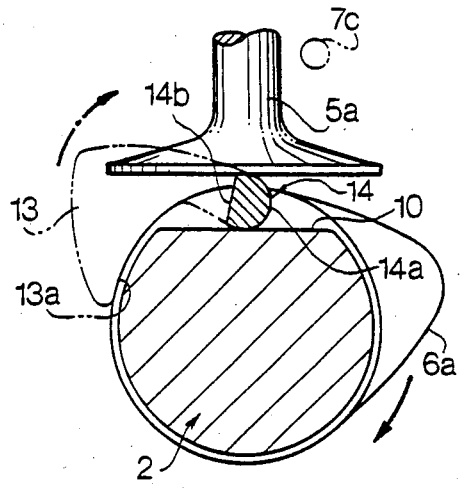
FIG. 4 is an enlarged sectional view taken along a line IV—IV of FIG. 1, explaining operation at the starting of the engine.
Figure 5:
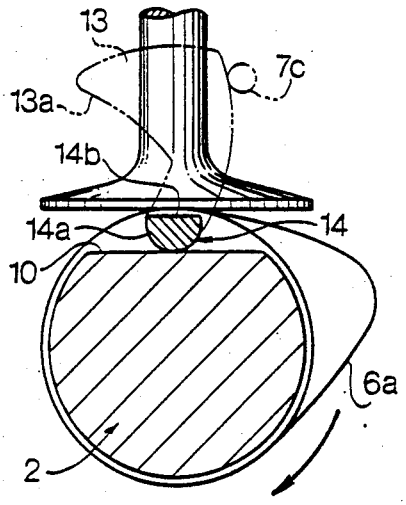
FIG. 5 is a similar view to FIG. 4 but explaining the operation during ordinary running of the engine.

An inner side 13*a* of the weight 13 has the same radius of curvature as the periphery of the camshaft 2. As shown in FIG. 4, the cylindrical portion 14*a* of the semicircular cam 14 raises the tappet 5*a* when the inner side 13*a* remains in contact with the outer surface of the camshaft 2. While as shown in FIG. 5, the flat reduced portion 14*b* is kept apart from the underside of the tappet 5*a* when the weight 13 rotates due to the centrifugal force.

The releasing lever 12 is easily assembled in the decompression device by the following steps: inserting the end portion 12*b* of the shaft 12*a* into a hole provided in the bearing member 11; fixing the bearing member 11 with the releasing lever 12 in the recess 9 of the camshaft 2; engaging a snap ring 15 in an annular groove 2*b* formed on the camshaft 2; inserting the camshaft 2 with the bearing member 11 and the releasing lever 12 into the bore 7*a* of the cam gear 7 from the side of the gear 7 having the hollow 7*d*, so that the hollow 7*d* of the cam gear 7 is provided with the weight 13 of the releasing lever 12; and engaging another snap ring 15 on the other side of the cam gear 7, so that both snap rings 15, 15 engage with the cam shaft 2 to prevent the axial movement of the gear 7.

Accordingly, the cylindrical portion 14*a* formed on the semicircular cam 14 of the releasing lever 12 is supported on the flat bottom notch 10 of the camshaft 2. As a result, both ends, the semicircular cam 14 and the other end portion 12*b* of the shaft 12*a* are rotatably supported by the flat bottom notch 10 and the bearing member 11, respectively. And, the end of the cam 14 forms a small gap with the side wall of the cam 6*a*, so the releasing lever 12 is restricted from axial movement of the lever 12.

In operation, the camshaft 2 rotates in the clockwise direction according to the arrows shown in FIG. 4 at starting operation of the engine. At the beginning of the starting, the centrifugal force exerted on the weight 13 is small since the rotational speed of the camshaft 2 is low. As a result, the inner side 13*a* of the weight 13 maintains contact with the outer surface of the camshaft 2 by means of the force of a spring (not shown) or due to the weight of the weight 13 (see FIG. 4).

Therefore, in this state, the cylindrical portion 14*a* raises the tappet 5*a* under the compression stroke condition, thereby making the pressure in the combustion chamber (not shown) low.

According to the speed of the camshaft 2 increasing after the engine is started, the centrifugal force increases. Accordingly, the releasing lever 12 rotates in the clockwise direction against the weight of the weight 13 or the force of the spring (not shown) until the weight 13 comes to a position shown in FIG. 5. In this position, the flat reduced portion 14*b* of the cam 14 is positioned below the periphery of the cam 6*a*, releasing the tappet 5*a*. As a result, the tappet 5*a* engages with the cam 6*a*, so that the pressure in the combustion chamber increases to normally operate the engine.

When the engine stops, the centrifugal force decreases gradually. Accordingly, the releasing lever 12 rotates in the counterclockwise direction and returns to the original state.

According to the decompression device of the present invention as explained above, the releasing lever is rotatably supported by a bearing member which secures the cam gear and camshaft, so that the releasing lever can be easily positioned and assembled in place and available for various models of the engine.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. In a decompression apparatus for an engine having a camshaft, a cam gear having a longitudinal bore along a central axis thereof, and a tappet engaging with an actuating cam on the camshaft, the improvement comprising:

a releasing lever comprising a shaft and a weight secured to the shaft;

the shaft forming a semicircular cam at one end;

the camshaft having a first recess in a longitudinal direction;

the cam gear having a second recess adjacent the bore;

a bearing member for engaging with the first and second recesses and for rotatably supporting the shaft;

a flat bottom notch for supporting said semicircular cam and being provided on the camshaft close to the actuating cam; and the semicircular cam being arranged to project beyond a periphery of the actuating cam when engine operation is stopped.

2. The apparatus according to claim 1 wherein the weight is provided within a hollow formed on a side surface of the cam gear.

3. The apparatus according to claim 2 wherein the weight is secured to the shaft approximately at center in the longitudinal direction.

4. The apparatus according to claim 1 wherein one end of the camshaft is employed for an output shaft of the engine.

* * * * *